US011840936B1

(12) United States Patent
Freeman et al.

(10) Patent No.: US 11,840,936 B1
(45) Date of Patent: Dec. 12, 2023

(54) CERAMIC MATRIX COMPOSITE BLADE TRACK SEGMENT WITH PIN-LOCATING SHIM KIT

(71) Applicant: Rolls-Royce Corporation, Indianapolis, IN (US)

(72) Inventors: Ted J. Freeman, Danville, IN (US); Aaron D. Sippel, Zionsville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 18/072,147

(22) Filed: Nov. 30, 2022

(51) Int. Cl.
*F01D 25/24* (2006.01)
*F01D 11/08* (2006.01)

(52) U.S. Cl.
CPC ..... *F01D 25/246* (2013.01); *F01D 11/08* (2013.01); *F05D 2240/11* (2013.01); *F05D 2300/6033* (2013.01)

(58) Field of Classification Search
CPC ..... F01D 25/246
See application file for complete search history.

(56) References Cited

U.S. PATENT DOCUMENTS

| | | | |
|---|---|---|---|
| 3,066,911 | A | 12/1962 | Frederick, V et al. |
| 3,807,891 | A | 4/1974 | McDow et al. |
| 3,880,435 | A | 4/1975 | Thornbald |
| 4,676,715 | A | 6/1987 | Imbault et al. |
| 4,863,345 | A | 9/1989 | Thompson et al. |
| 5,080,557 | A | 1/1992 | Berger |
| 5,116,199 | A | 5/1992 | Ciokajlo |
| 5,203,673 | A | 4/1993 | Evans |
| 5,295,787 | A | 3/1994 | Leonard et al. |
| 5,459,995 | A | 10/1995 | Norton et al. |
| 5,584,651 | A | 12/1996 | Pietraszkiewicz et al. |
| 5,593,276 | A | 1/1997 | Proctor et al. |
| 5,609,469 | A | 3/1997 | Worley et al. |
| 6,142,731 | A | 11/2000 | Dewis et al. |
| 6,821,085 | B2 | 11/2004 | Darkins et al. |
| 6,877,952 | B2 | 4/2005 | Wilson |
| 6,884,026 | B2 | 4/2005 | Glynn et al. |
| 7,210,899 | B2 | 5/2007 | Wilson, Jr |
| 7,494,317 | B2 | 2/2009 | Keller et al. |
| 7,534,086 | B2 | 5/2009 | Mazzola et al. |
| 7,726,936 | B2 * | 6/2010 | Keller ..... F01D 11/12 415/214.1 |
| 7,753,643 | B2 | 7/2010 | Gonzalez et al. |
| 8,128,350 | B2 | 3/2012 | Schiavo et al. |

(Continued)

FOREIGN PATENT DOCUMENTS

| | | | |
|---|---|---|---|
| FR | 3056636 | A1 | 3/2018 |

*Primary Examiner* — Courtney D Heinle
*Assistant Examiner* — Danielle M. Christensen
(74) *Attorney, Agent, or Firm* — Barnes & Thornburg LLP

(57) ABSTRACT

A turbine shroud assembly includes a carrier assembly, a blade track segment, a retainer, and a clip shim. The carrier assembly is arranged circumferentially at least partway around an axis. The blade track segment is supported by the carrier assembly to locate the blade track segment radially outward of the axis and define a portion of a gas path of the turbine shroud assembly. The retainer extends into the carrier assembly and the blade track segment. The clip shim is located between the carrier assembly and the blade track and configured to urge the blade track segment axially toward the carrier assembly.

17 Claims, 4 Drawing Sheets

(56) References Cited

U.S. PATENT DOCUMENTS

| | | | |
|---|---|---|---|
| 8,388,309 | B2 | 3/2013 | Marra et al. |
| 8,790,067 | B2 | 7/2014 | Mccaffrey et al. |
| 8,905,709 | B2 | 12/2014 | Dziech et al. |
| 8,944,756 | B2 | 2/2015 | Lagueux |
| 8,979,489 | B2 | 3/2015 | Taillant et al. |
| 9,587,504 | B2 | 3/2017 | Mccaffrey et al. |
| 9,587,517 | B2 | 3/2017 | Vetters et al. |
| 9,863,265 | B2 | 1/2018 | Stapleton |
| 9,874,104 | B2 | 1/2018 | Shapiro |
| 10,024,193 | B2 | 7/2018 | Shapiro |
| 10,030,541 | B2 | 7/2018 | Vetters et al. |
| 10,082,039 | B2 | 9/2018 | Hanson |
| 10,132,197 | B2 | 11/2018 | Heitman et al. |
| 10,174,628 | B2 | 1/2019 | Humhauser et al. |
| 10,301,960 | B2 | 5/2019 | Stapleton et al. |
| 10,370,991 | B2 | 8/2019 | Wilson et al. |
| 10,378,385 | B2 | 8/2019 | Tesson et al. |
| 10,378,386 | B2 | 8/2019 | Roussille et al. |
| 10,415,426 | B2 | 9/2019 | Quennehen et al. |
| 10,415,427 | B2 | 9/2019 | Quennehen et al. |
| 10,422,241 | B2 | 9/2019 | Mccaffrey et al. |
| 10,428,688 | B2 | 10/2019 | Quennehen et al. |
| 10,577,963 | B2 | 3/2020 | Mccaffrey |
| 10,590,803 | B2 | 3/2020 | Quennehen et al. |
| 10,598,045 | B2 | 3/2020 | Tableau et al. |
| 10,605,120 | B2 | 3/2020 | Quennehen et al. |
| 10,619,517 | B2 | 4/2020 | Quennehen et al. |
| 10,626,745 | B2 | 4/2020 | Roussille et al. |
| 10,655,501 | B2 | 5/2020 | Lepretre et al. |
| 10,689,998 | B2 | 6/2020 | Stapleton et al. |
| 10,690,007 | B2 | 6/2020 | Quennehen et al. |
| 10,724,399 | B2 | 7/2020 | Carlin et al. |
| 10,753,221 | B2 | 8/2020 | Barker et al. |
| 10,787,924 | B2 | 9/2020 | Quennehen et al. |
| 10,815,810 | B2 | 10/2020 | Barker et al. |
| 10,907,487 | B2 | 2/2021 | Zurmehly et al. |
| 10,907,501 | B2 | 2/2021 | Filippi et al. |
| 10,934,872 | B2 | 3/2021 | Tableau et al. |
| 10,968,761 | B2 | 4/2021 | Barker et al. |
| 11,015,613 | B2 | 5/2021 | Kerns et al. |
| 11,021,988 | B2 | 6/2021 | Tableau et al. |
| 11,021,990 | B2 | 6/2021 | Filippi |
| 11,028,720 | B2 | 6/2021 | Tableau et al. |
| 11,041,399 | B2 | 6/2021 | Utjen et al. |
| 11,047,245 | B2 | 6/2021 | Mccaffrey |
| 11,066,947 | B2 * | 7/2021 | Sippel ..... F01D 25/246 |
| 11,078,804 | B2 | 8/2021 | Tableau et al. |
| 11,085,316 | B2 | 8/2021 | Barker et al. |
| 11,085,317 | B2 | 8/2021 | Johnson et al. |
| 11,111,822 | B2 | 9/2021 | Tableau et al. |
| 11,111,823 | B2 | 9/2021 | Jarrossay et al. |
| 11,143,050 | B2 | 10/2021 | Roy Thill et al. |
| 11,174,747 | B2 | 11/2021 | Roy Thill et al. |
| 11,174,795 | B2 | 11/2021 | Lutjen et al. |
| 11,215,064 | B2 | 1/2022 | Arbona et al. |
| 11,215,081 | B2 | 1/2022 | Schilling et al. |
| 11,255,209 | B2 | 2/2022 | Clark et al. |
| 11,286,812 | B1 * | 3/2022 | Freeman ..... F01D 25/246 |
| 11,326,470 | B2 | 5/2022 | Dyson et al. |
| 11,365,635 | B2 | 6/2022 | Read et al. |
| 11,441,434 | B2 | 9/2022 | Danis et al. |
| 11,466,585 | B2 | 10/2022 | Arbona et al. |
| 2009/0208284 | A1 | 8/2009 | Funnell |
| 2016/0186611 | A1 | 6/2016 | Vetters et al. |
| 2016/0186999 | A1 | 6/2016 | Freeman et al. |
| 2016/0319688 | A1 | 11/2016 | Thibault et al. |
| 2016/0333715 | A1 | 11/2016 | Mccaffrey |
| 2017/0268366 | A1 | 9/2017 | Mccaffrey et al. |
| 2018/0051581 | A1 | 2/2018 | Quennehen et al. |
| 2018/0051591 | A1 | 2/2018 | Quennehen et al. |
| 2018/0073398 | A1 | 3/2018 | Quennehen et al. |
| 2018/0080343 | A1 | 3/2018 | Groleau et al. |
| 2018/0156069 | A1 | 6/2018 | Quennehen et al. |
| 2018/0291769 | A1 | 10/2018 | Vetters et al. |
| 2018/0355761 | A1 | 12/2018 | Maar |
| 2019/0040758 | A1 | 2/2019 | Quennehen et al. |
| 2019/0040761 | A1 | 2/2019 | Carlin et al. |
| 2019/0084892 | A1 | 3/2019 | Subramanian et al. |
| 2019/0101027 | A1 | 4/2019 | Lepretre et al. |
| 2019/0128132 | A1 | 5/2019 | Tableau et al. |
| 2021/0131300 | A1 | 5/2021 | Arbona et al. |
| 2022/0003126 | A1 | 1/2022 | Roy Thill et al. |
| 2022/0056809 | A1 | 2/2022 | Hock et al. |
| 2022/0120198 | A1 | 4/2022 | Schilling et al. |

* cited by examiner

CERAMIC MATRIX COMPOSITE BLADE TRACK SEGMENT WITH PIN-LOCATING SHIM KIT

FIELD OF THE DISCLOSURE

The present disclosure relates generally to gas turbine engines, and more specifically to turbine shroud assemblies adapted for use in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors and turbines typically include alternating stages of static vane assemblies and rotating wheel assemblies. The rotating wheel assemblies include disks carrying blades around their outer edges. When the rotating wheel assemblies turn, tips of the blades move along blade tracks included in static shrouds that are arranged around the rotating wheel assemblies. Such static shrouds may be coupled to an engine case that surrounds the compressor, the combustor, and the turbine.

Some shrouds positioned in the turbine may be exposed to high temperatures from products of the combustion reaction in the combustor. Such shrouds sometimes include components made from materials that have different coefficients of thermal expansion. Due to the differing coefficients of thermal expansion, the components of some turbine shrouds expand at different rates when exposed to combustion products. In some examples, coupling such components with traditional arrangements may not allow for the differing levels of expansion and contraction during operation of the gas turbine engine.

SUMMARY

The present disclosure may comprise one or more of the following features and combinations thereof.

According to an aspect of the disclosure, a turbine shroud assembly for use with a gas turbine engine includes a carrier assembly, a blade track segment, a retainer, and a clip shim. The carrier assembly may be made of metallic materials and is arranged circumferentially at least partway around an axis. The carrier assembly includes an outer wall, a forward mount wall that extends radially inward from the outer wall, an intermediate mount that includes a first intermediate mount wall that extends radially inward from the outer wall and a second intermediate mount wall that extends radially inward from the outer wall, and an aft mount wall axially spaced apart from the intermediate mount and that extends radially inward from the outer wall. The aft mount wall includes an aft flange and a chordal seal that extends axially away from the aft flange.

The blade track segment may be made of ceramic matrix composite materials. The blade track segment is supported by the carrier assembly to locate the blade track segment radially outward of the axis and define a portion of a gas path of the turbine shroud assembly. The blade track segment includes a shroud wall that extends circumferentially partway around the axis, a first attachment flange that extends radially outward from the shroud wall into a forward space between the forward mount wall and the first intermediate mount wall, and a second attachment flange that extends radially outward from the shroud wall into an aft space between the second intermediate mount wall and the aft mount wall.

The retainer includes a forward pin that extends through the first attachment flange and into the first intermediate mount wall and an aft pin that extends into the second intermediate mount wall, through the second attachment flange, and into the aft mount wall so as to couple the blade track assembly to the carrier assembly. The clip shim is arranged around the second attachment flange and configured to engage the second attachment flange and the second intermediate mount wall and urge the second attachment flange axially aft relative to the axis and into engagement with the chordal seal.

In some embodiments, the clip shim includes a top wall that extends axially, a shim wall that extends radially from the top wall and is located axially between and engaged with the second intermediate mount wall and the second attachment flange, and a clip wall that is spaced apart from the shim wall and extends radially from the top wall along the second attachment flange.

In some embodiments, the shim wall, the clip wall, and the top wall cooperate to provide a spring force that clamps the clip shim onto the second attachment flange. In some embodiments, the shim wall forms a first pin receiving cutout that extends radially outward and is sized to receive at least a first portion of the retainer. In some embodiments, the clip wall forms a second pin receiving cutout that extends radially outward and is sized to receive at least a second portion of the retainer.

In some embodiments, the fore carrier segment further includes an engagement lip that extends axially aft from the forward mount wall and engages the first attachment flange of the blade track segment.

In some embodiments, the forward mount wall and the aft mount wall are spaced apart axially by a distance such that the engagement lip and the chordal seal apply an axial compressive force to the first attachment flange and the second attachment flange. In some embodiments, the forward pin has an aft most end that extends into the first intermediate mount wall and terminates axially forward of the second intermediate mount wall and the aft pin has a fore most end that extends into the second intermediate mount wall and terminates axially aft of the first intermediate mount wall.

According to another aspect of the disclosure, a turbine shroud assembly for use with a gas turbine engine includes a carrier assembly, a blade track segment, a retainer, and a clip shim. The carrier assembly may be arranged circumferentially at least partway around an axis. The carrier assembly includes an outer wall and a forward mount wall that extends radially inward from the outer wall, an intermediate mount that extends radially inward from the outer wall, and an aft mount wall axially spaced apart from the intermediate mount and that extends radially inward from the outer wall.

The blade track segment is supported by the carrier assembly. The blade track segment includes a shroud wall that extends circumferentially partway around the axis, a first attachment flange that extends radially outward from the shroud wall into a forward space between the forward mount wall and the intermediate mount, and a second attachment flange that extends radially outward from the shroud wall into an aft space between the intermediate mount and the aft mount wall. The retainer extends into the forward mount wall, the first attachment flange, the intermediate mount, the second attachment flange, and the aft mount wall so as to couple the blade track assembly to the carrier assembly. The clip shim is located between the intermediate mount and the second attachment flange and configured to urge the second attachment flange axially aft toward the aft mount wall.

In some embodiments, the aft mount wall includes an aft flange and a chordal seal that extends axially away from the aft flange. The clip shim urges the second attachment flange into engagement with the chordal seal.

In some embodiments, the clip shim includes a top wall that extends axially, a shim wall that extends radially from the top wall and is located axially between and engaged with the second intermediate mount wall and the second attachment flange, and a clip wall that is spaced apart from the shim wall and extends radially from the top wall along the second attachment flange. In some embodiments, the shim wall, the clip wall, and the top wall cooperate to provide a spring force that clamps the clip shim onto the second attachment flange.

In some embodiments, the shim wall forms a first pin receiving cutout that extends radially outward and is sized to receive at least a first portion of the retainer. In some embodiments, the clip wall forms a second pin receiving cutout that extends radially outward and is sized to receive at least a second portion of the retainer.

In some embodiments, the retainer includes a first pin that extends into the forward mount wall, through the first attachment flange, and into the intermediate mount and an aft pin that extends into the intermediate mount, through the second attachment flange, and into the aft mount.

In some embodiments, the intermediate mount includes a first intermediate mount wall and a second intermediate mount wall spaced apart axially from the first intermediate mount wall to form a gap therebetween. In some embodiments, the retainer includes a pin that extends continuously into the forward mount wall, the first attachment flange, the intermediate mount, the second attachment flange, and the aft mount wall.

A method of forming a turbine shroud assembly includes a number of steps. The method may include providing a carrier assembly having an outer wall, a first mount wall that extends radially inward from the outer wall, an intermediate mount that extends radially inward from the outer wall, and a second mount wall axially spaced apart from the intermediate mount and that extends radially inward from the outer wall, providing a blade track segment made of ceramic matrix composite materials, the blade track segment including a shroud wall that extends circumferentially partway around the axis, a first attachment flange that extends radially outward from the shroud wall, and a second attachment flange that extends radially outward from the shroud wall, arranging a clip shim between the intermediate mount and the second attachment flange to cause the clip shim to urge the second attachment flange toward the second mount wall, and inserting a retainer into the first mount wall, the first attachment flange, the intermediate mount, the second attachment flange, and the second mount wall.

In some embodiments, the second mount wall is formed to include a flange and a chordal seal that extends axially away from the flange and engages the second attachment flange. In some embodiments, the clip shim includes a top wall that extends axially, a shim wall that extends radially from the top wall and is located axially between and engaged with the intermediate mount and the second attachment flange, and a clip wall that is spaced apart from the shim wall and extends radially from the top wall along the second attachment flange.

These and other features of the present disclosure will become more apparent from the following description of the illustrative embodiments.

DETAILED DESCRIPTION OF THE DRAWINGS

Figure 1:
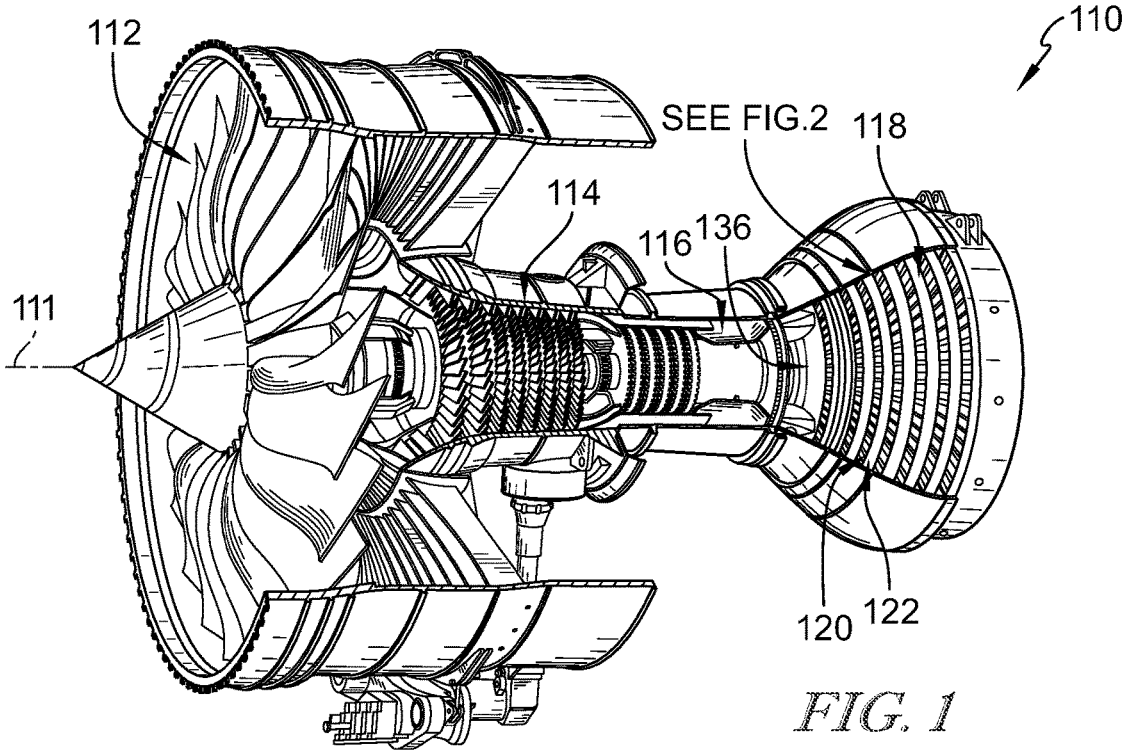
FIG. 1 is a cutaway perspective view of a gas turbine engine that includes a fan, a compressor, a combustor, and a turbine, the turbine includes a turbine shroud assembly that extends circumferentially around an axis and turbine wheels that are driven to rotate about the axis to generate power.

For the purposes of promoting an understanding of the principles of the disclosure, reference will now be made to a number of illustrative embodiments illustrated in the drawings and specific language will be used to describe the same.

An illustrative aerospace gas turbine engine 110 includes a fan 112, a compressor 114, a combustor 116, and a turbine 118 as shown in FIG. 1. The fan 112 is driven by the turbine 118 and provides thrust for propelling an air vehicle. The compressor 114 compresses and delivers air to the combustor 116. The combustor 116 mixes fuel with the compressed air received from the compressor 114 and ignites the fuel.

The hot, high-pressure products of the combustion reaction in the combustor 116 are directed into the turbine 118 to cause the turbine 118 to rotate about an axis 111 and drive the compressor 114 and the fan 112. In some embodiments, the fan 112 may be replaced with a propeller, drive shaft, or other suitable configuration.

Figure 2:
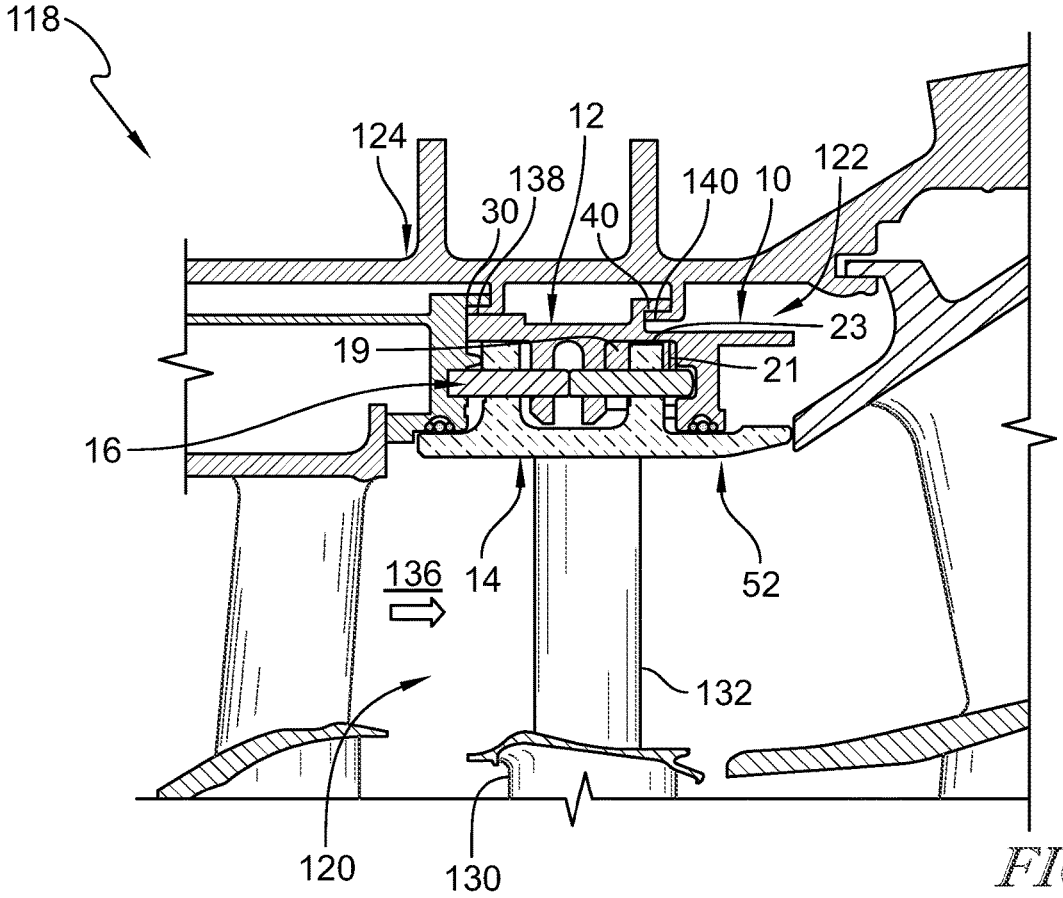
FIG. 2 is a cross-sectional view of a portion of the turbine included in the gas turbine engine of FIG. 1 showing one of the turbine wheel assemblies and the turbine shroud arranged around the turbine wheel assembly, the turbine shroud including a carrier assembly including a fore carrier segment and an aft carrier segment coupled with the fore carrier, a blade track segment supported by the carrier assembly, a retainer that includes a forward pin and an aft pin to couple the blade track segment to the carrier assembly, and clip shims located between the blade track segment and the aft carrier segment to axially locate the blade track segment.

The turbine 118 includes at least one turbine wheel assembly 120 and a turbine shroud 122 positioned to surround the turbine wheel assembly 120 as shown in FIGS. 1 and 2. The turbine wheel assembly 120 includes a plurality of blades 132 coupled to a rotor disk 130 for rotation with the rotor disk 130. The hot, high pressure combustion products from the combustor 116 are directed toward the blades 132 of the turbine wheel assemblies 120 along a flow path 136. The turbine shroud 122 is coupled to an outer case 124 of the gas turbine engine 110 and extends around the turbine wheel assembly 120 to block gases from passing over the turbine blades 132 during use of the turbine 118 in the gas turbine engine 110.

In the illustrative embodiment, the turbine shroud 122 is made up of a number of turbine shroud assemblies 10 that each extend circumferentially partway around the axis 111 and cooperate to surround the turbine wheel assembly 120. In other embodiments, the turbine shroud 122 is annular and non-segmented to extend fully around the central axis 111 and surround the turbine wheel assembly 120. In yet other embodiments, certain components of the turbine shroud 122 are segmented while other components are annular and non-segmented.

Figure 3:
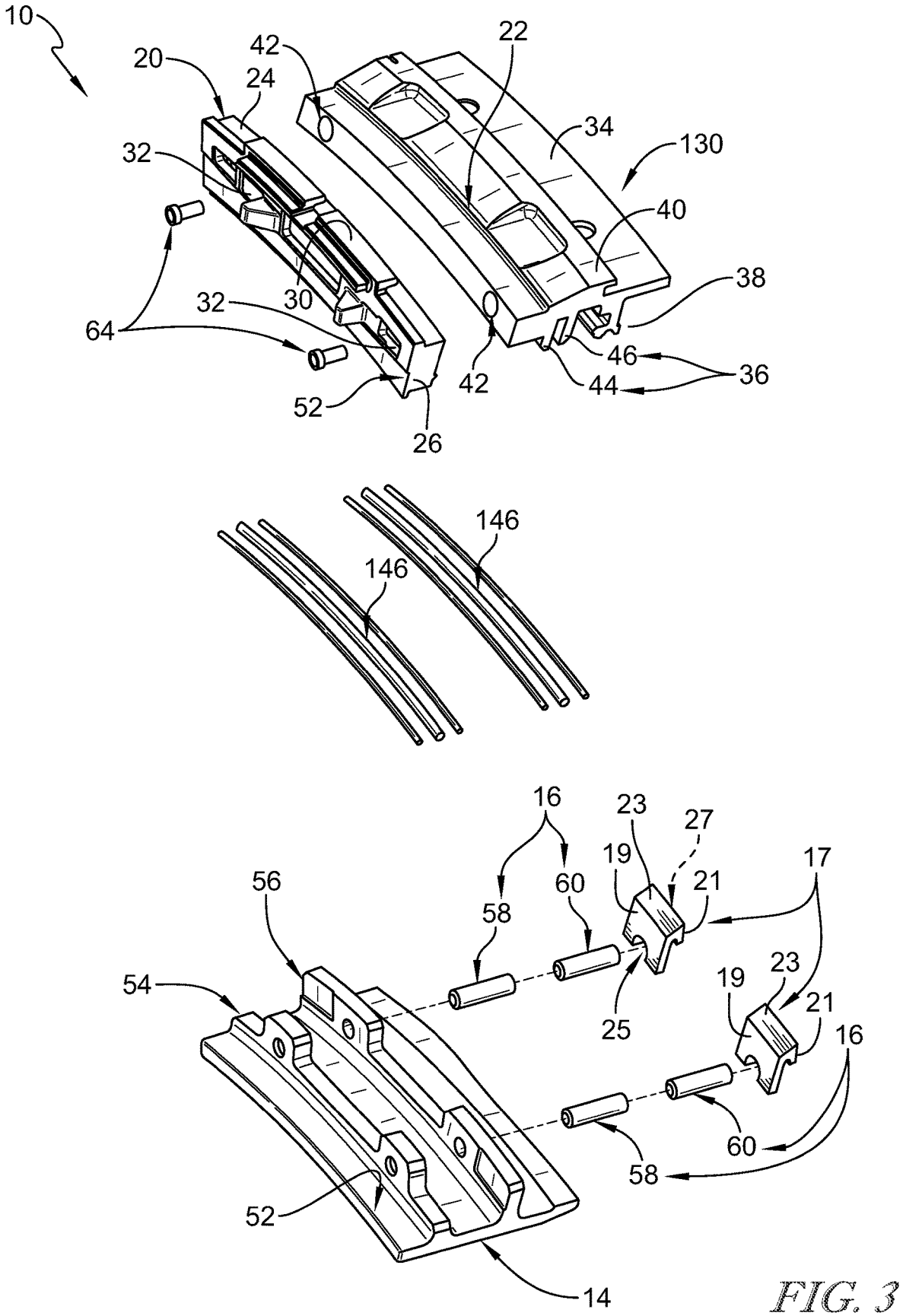
FIG. 3 is an exploded view of the turbine shroud of FIG. 2 showing from top to bottom, the carrier assembly including the fore carrier segment and the aft carrier segment, a plurality of seal elements, the blade track segment, two clip shims and two retainers that each include a forward pin and an aft pin located axially aft of the forward pin.
Figure 4:
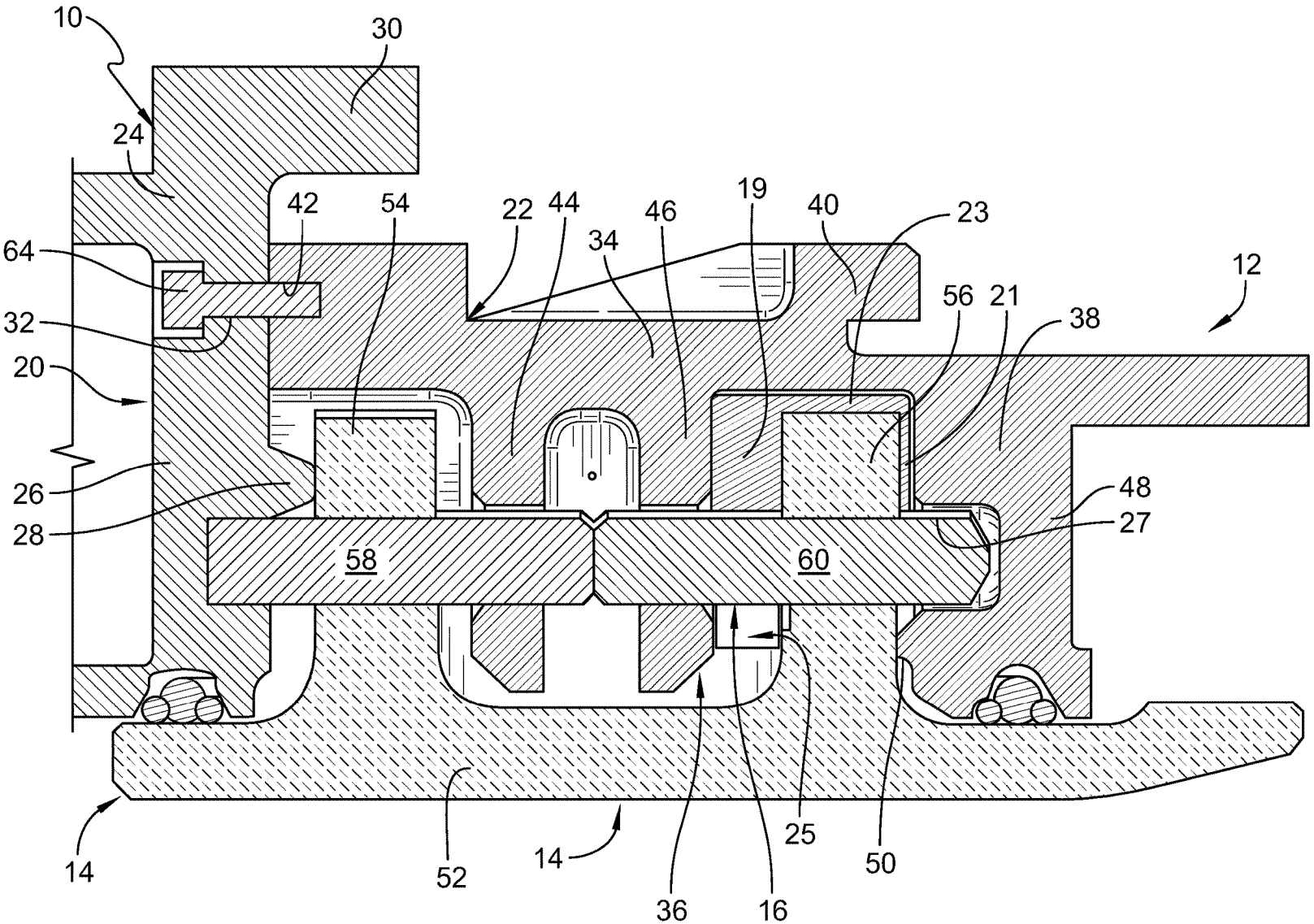
FIG. 4 is detailed cross-section view of the turbine shroud assembly of FIG. 2 showing the carrier assembly, the blade track segment, one of the retainers, and one of the clip shims and further showing the clip shim arranged around an attachment flange of the blade track segment and engaged with the carrier assembly to urge the blade track segment axially into engagement with a chordal seal of the carrier assembly.

Each turbine shroud assembly 10 includes a carrier assembly 12, a blade track segment 14, two clip shims 17, and at least two retainers 16 as shown in FIGS. 2 and 3. The carrier assembly 12 is made of metallic materials and is arranged circumferentially at least partway around the axis 111, as shown in FIGS. 3 and 4. The carrier assembly 12 couples the blade track segment 14 with the case hanger arms 138, 140 to support the blade track segment 14 radially outside of the plurality of blades 132 of the turbine wheel assembly 120. The blade track segment 14 is supported by the carrier assembly 12 to locate the blade track segment 14 radially outward of the axis 111 and define a portion of the gas path 136. The retainers 16 extend into the carrier assembly 12 and the blade track segment 14 to couple the blade track segment 14 with the carrier assembly 12.

In the illustrative embodiment, the carrier assembly 12 includes a fore carrier segment 20, an aft carrier segment 22 coupled with the fore carrier segment 20, and fasteners 64 for coupling the fore carrier segment 20 and the aft carrier segment 22 together as shown in FIG. 4. In other embodiments, the carrier assembly 12 is one-piece and the fore carrier segment 20 and the aft carrier segment 22 are integral. The fore carrier segment 20 cooperates with the aft carrier segment 22 to support the blade track segment 14 radially outside the plurality of blades 132 of the turbine wheel assembly 120. The two-piece design of the carrier assembly 12 allows each retainer 16 to be inserted in an axial aft direction into the blade track segment 14 and aft carrier segment 22. The fore carrier segment 20 is then coupled with the aft carrier segment 22 to block the retainers 16 from escaping the assembly.

The fore carrier segment 20 includes a forward outer wall 24, a forward mount wall 26, an engagement lip 28, and a fore hanger arm 30, as shown in FIG. 4. The forward outer wall 24 extends at least partway circumferentially about the axis 111. The forward mount wall 26 extends radially inward from the forward outer wall 24 and is formed to define openings that extend axially into the forward mount wall 26 and each opening is sized to receive a portion of the corresponding retainer 16. The forward mount wall 26 is further formed to include forward fastener holes 32 for receiving fasteners 64 therein. The engagement lip 28 extends axially aft from a portion of the forward mount wall 26 located radially outward from the forward pin 58 and engages with the blade track segment 14 to locate the blade track segment 14 axially relative to the fore carrier segment 20. The fore hanger arm 30 extends radially outward away from the forward outer wall 24 and axially so as to be configured to be supported on the case hanger arms 138, 140 of the turbine section 118.

The aft carrier segment 22 includes an aft outer wall 34, an intermediate mount 36, an aft mount wall 38, and an aft hanger arm 40, as shown in FIGS. 3 and 4. The aft outer wall 34 extends circumferentially at least partway around the axis 111 and is formed to include aft fastener holes 42 for receiving fasteners 64. The fore outer wall 24 and the aft outer wall 34 may be the same outer wall in embodiments with a one-piece integral carrier assembly 12. The intermediate mount 36 and the aft mount wall 38 both extend radially inward from the aft outer wall 34 and are configured to receive at least a portion of the retainers 16 therein. The aft hanger arm 40 extends radially outward away from the aft mount wall 38 and axially, such that when assembled, the fore carrier segment 20 and the aft carrier segment 22 are supported by the case hanger arms 138, 140 of the turbine section 118.

The intermediate mount 36 includes a first intermediate mount wall 44 and a second intermediate mount wall 46. The first intermediate mount wall 44 extends radially inward from the aft outer wall 34. The second intermediate mount wall 46 extends radially inward from the aft outer wall 34. The second intermediate mount wall 46 is spaced apart axially from the first intermediate mount wall 44 to form a channel therebetween. In some embodiments, the intermediate mount 36 defines a single wall and does not include two spaced apart walls 44, 46. The intermediate mount 36 may be formed to include air passages that extend radially through the intermediate mount 36. The aft mount wall 38 extends radially inward from the aft outer wall 34 and is axially spaced apart from the intermediate mount 36 as shown in FIG. 4. The fasteners 64 extend into the forward mount wall 26, through the forward fastener hole 32 of the forward mount wall 26 and into the aft fastener hole 42 of the aft outer wall 34.

The aft mount wall 38 includes an aft flange 48 and a chordal seal 50, as shown in FIG. 4. The chordal seal 50 extends axially forward away from the aft flange 48 as well as circumferentially and engages the blade track segment 14 to locate the blade track segment axially relative to the aft flange 48. The chordal seal 50 blocks air flow between the blade track segment 14 and the aft flange 48 and seals off gases flowing along the gas path 128 radially within the blade track segment 14. The aft mount wall 38 is spaced axially apart from the forward mount wall 26 such that the engagement lip 28 and the chordal seal 50 apply an axial compressive force to the blade track segment 14. The chordal seal 50 extends axially away from the aft flange 48.

The blade track segment 14 includes a shroud wall 52, a first attachment flange 54, and a second attachment flange 56, as show in FIGS. 3 and 4. The shroud wall 52 extends circumferentially partway around the axis 111 and prevents gases from passing over the plurality of blades 132 of the turbine wheel assembly 120. The first attachment flange 54 extends radially outward from the shroud wall 52 and into a forward space between the forward mount wall 26 and the first intermediate mount wall 44. The second attachment flange 56 extends radially outward from the shroud wall 52 into an aft space between the second intermediate mount wall 46 and the aft mount wall 38. The fore carrier segment 20 is coupled with the aft carrier segment 22 such that the engagement lip 28 applies an aft force onto the first attachment flange 54. The chordal seal 50 applies a forward force onto the second attachment flange 56 such that the axial compressive force is applied to the blade track segment 14.

The carrier assembly 12 further includes seals 66 and 68 as shown in FIGS. 3 and 4. The seal 66 is located in a channel and engages the shroud wall 52 and the forward carrier segment 20. The seal 68 is located in a channel and engages the shroud wall 52 and the aft carrier segment 22. Each of the seals 66, 68 include a rope seal and a pair of wire seals, one wire seal on each side of the associated rope seal. In other embodiments, seals 66, 68 could include other seal types.

Each retainer 16 includes a forward pin 58 and an aft pin 60 as shown in FIGS. 2, 3 and 4. The forward pin 58 extends into the forward mount wall 26, through the first attachment flange 54, and into the first intermediate mount wall 44. The aft pin 60 extends into the second intermediate mount wall 46, through the second attachment flange 56, and into the aft mount wall 38 so as to couple the blade track segment 14 to the carrier assembly 12. In the illustrative embodiment, the forward pin 58 and the aft pin 60 are in direct confronting relation such that they may abut each other during operation of the gas turbine engine 110. The forward pin 58 and the aft pin 60 are aligned radially and circumferentially. The aft pin 60 is located axially aft of the forward pin 58.

Each clip shim 17 includes a shim wall 19, a clip wall 21, and a top wall 23, as shown in FIGS. 2, 3, and 4. The shim wall 19 extends radially inward from the top wall 23 around the aft pin 60 and into the space between the second attachment flange 56 and the second intermediate wall 46. The shim wall 19 is sized to engage the second intermediate wall 46 and the second attachment flange and urge the second attachment flange 56 into engagement with the chordal seal 50 to block the flow of gases. The shim wall 19 may be selected or machined to remove or add material to achieve a desired axial thickness to provide the desired axial force onto the second intermediate wall 46.

The shim wall 19 is a rigid material in the illustrative embodiment adapted to apply a force due to interference fit. In some embodiments, the clip shim 17 is made of a material with some compliance to allow for the forces to be distributed on the second attachment flange 56 while providing the urging force to the second attachment flange 56. In some embodiments, the clip wall 21 and/or top wall 23 may be omitted.

The shim wall 19 is defined to form a first pin receiving cutout 25 in the illustrative embodiment. The clip wall 21 is spaced axially from the shim wall 19 and extends radially inward from the top wall 23 into the space between the second attachment flange 56 and the aft flange 48. The clip wall 21 is defined to form a second pin receiving cutout 27. The top wall 23 extends axially from the shim wall 19 to the clip wall 21. In some embodiments, the clip wall 21 extends radially inward a limited amount and no second pin receiving cutout 27 is formed in the clip wall 21. The shim wall 19, the clip wall 21, and the top wall 23 may cooperate to provide a spring force that clamps onto the second attachment flange 56.

Figure 5:
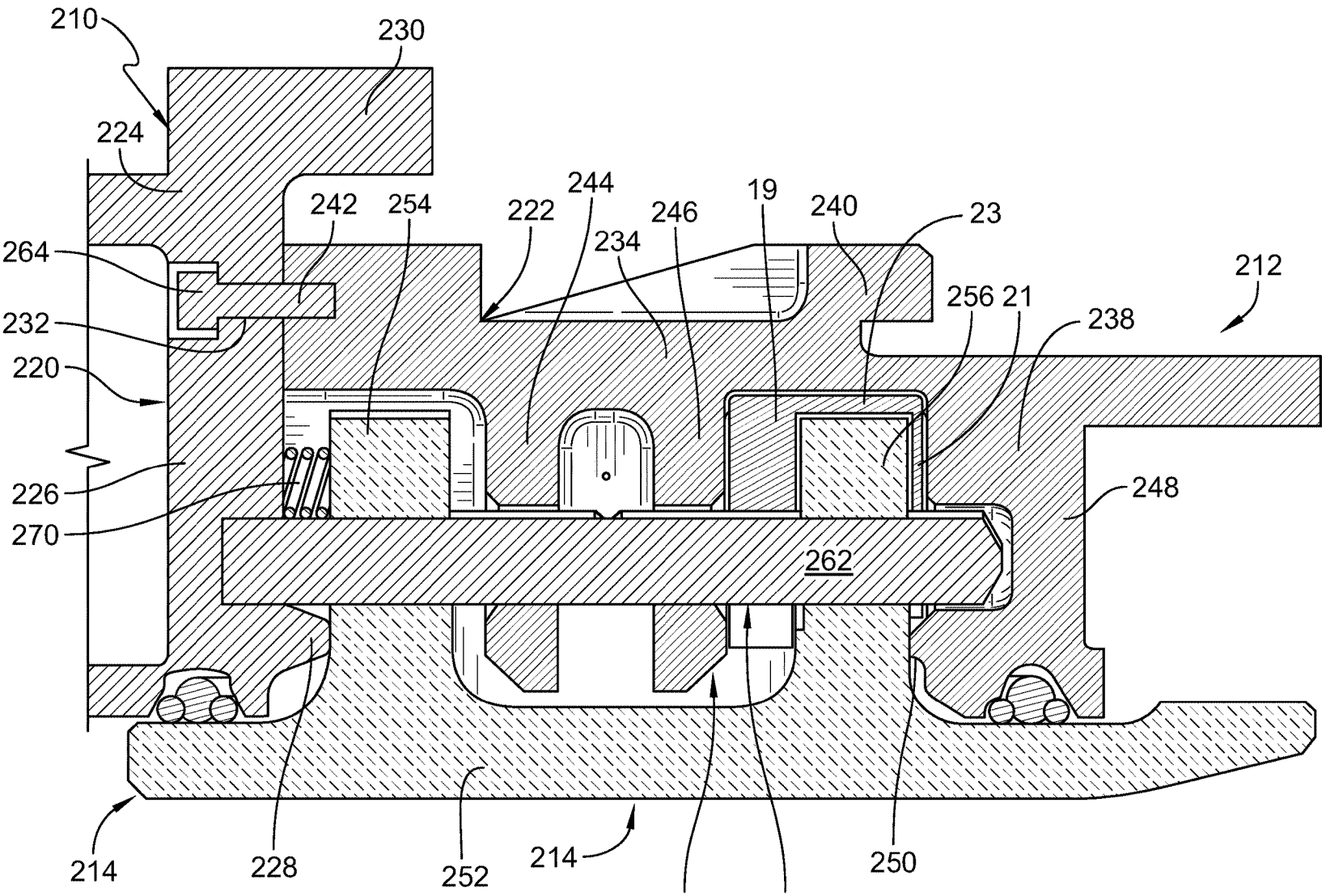
FIG. 5 is detailed cross-section view of another turbine shroud assembly adapted for use in the gas turbine engine of FIG. 1 showing the carrier assembly, the blade track segment, a single, one-piece retainer, and one of the clip shims and further showing the clip shim arranged around an attachment flange of the blade track segment and engaged with the carrier assembly to urge the blade track segment axially into engagement with a chordal seal of the carrier assembly.

Another embodiment of a turbine shroud assembly 210 in accordance with the present disclosure is shown in FIG. 5. The turbine shroud assembly 210 is substantially similar to the turbine shroud assembly 10 shown in FIGS. 1-4 and described herein. Accordingly, similar reference numbers in the 200 series indicate features that are common between the turbine shroud assembly 210 and the turbine shroud assembly 10. The description of the turbine shroud assembly 10 is incorporated by reference to apply to the turbine shroud assembly 210, except in instances when it conflicts with the specific description and the drawings of the turbine shroud assembly 210. The turbine shroud assembly 210 includes retainers 216 that each include a single pin as compared to the forward pins 58 and the aft pins 60 of the retainers 16 in the turbine shroud assembly 10.

Each turbine shroud assembly 210 includes a carrier assembly 212, a blade track segment 214, and the retainers 216 as shown in FIG. 5. The carrier assembly 212 extends circumferentially at least partway around the axis 111. The carrier assembly 212 includes a fore carrier segment 220 and an aft carrier segment 222 coupled with the fore carrier segment 220 as shown in FIG. 5. The two-piece design of the carrier assembly 212 allows each retainer 216 to be inserted in an axial aft direction into the blade track segment 214 and aft carrier segment 222. The fore carrier segment 220 is then coupled with the aft carrier segment 222 to block the retainers 216 from escaping the assembly.

In the illustrative embodiment, the turbine shroud assembly 26 further includes a biasing member 270 located axially between the forward mount wall 226 and the first attachment flange 254, as shown in FIG. 5. The biasing member 270 abuts the axially aft facing surface of the forward mount wall 226 and the axially forward facing surface of the first attachment flange 254 such that the biasing member 270 biases the entire blade track segment 214 thereby increasing contact between the second attachment flange 256 and the chordal seal 50.

The fore carrier segment 220 includes a forward outer wall 224, a forward mount wall 226, an engagement lip 228, and a fore hanger arm 230, as shown in FIG. 5. The forward outer wall 224 extends at least partway circumferentially about the axis 111. The forward mount wall 226 extends radially inward from the forward outer wall 224 and is formed to define openings that extend axially into the forward mount wall 226 and each opening is sized to receive a portion of the corresponding retainer 216. The engagement lip 228 extends axially aft from a portion of the forward mount wall 226 located radially outward from the forward pin 58 and engages with the blade track segment 214 to locate the blade track segment 214 axially relative to the fore carrier segment 220. The fore hanger arm 230 extends radially outward away from the forward outer wall 224.

The aft carrier segment 222 includes an aft outer wall 234, an intermediate mount 236, an aft mount wall 238, and an aft hanger arm 240, as shown in FIG. 5. The aft outer wall 234 extends circumferentially at least partway around the axis 111 and is formed to include aft fastener holes 242 for receiving fasteners 264. The intermediate mount 236 and the aft mount wall 238 both extend radially inward from the aft outer wall 234 and are configured to receive at least a portion of the retainers 216 therein. The aft hanger arm 240 extends radially outward away from the aft mount wall 238 and axially, such that when assembled, the fore carrier segment 220 and the aft carrier segment 222 are supported by the case hanger arms 138, 140 of the turbine section 118.

The intermediate mount 236 includes a first intermediate mount wall 244 and a second intermediate mount wall 246. The first intermediate mount wall 244 extends radially inward from the aft outer wall 234. The second intermediate mount wall 246 extends radially inward from the aft outer wall 234. The second intermediate mount wall 246 is spaced apart axially from the first intermediate mount wall 244 to form a channel therebetween.

In some embodiments, the intermediate mount 236 defines a single wall and does not include two spaced apart walls 244, 246. The intermediate mount 236 may be formed to include air passages that extend radially through the intermediate mount 236. The aft mount wall 238 extends radially inward from the aft outer wall 234 and is axially spaced apart from the intermediate mount 236 as shown in FIG. 5. The fasteners 264 extend into the forward mount wall 226, through the fore fastener hole 232 of the forward mount wall 226 and into the aft fastener hole 242 of the aft outer wall 234.

The aft mount wall 238 includes an aft flange 248 and a chordal seal 250, as shown in FIG. 5. The chordal seal 250 extends axially forward away from the aft flange 248 as well as circumferentially. The aft mount wall 238 is spaced axially apart from the forward mount wall. The chordal seal 250 extends axially away from the aft flange 248.

The blade track segment 214 includes a shroud wall 252, a first attachment flange 254, and a second attachment flange 256, as shown in FIG. 5. The shroud wall 252 extends circumferentially partway around the axis 111. The first attachment flange 254 extends radially outward from the shroud wall 252 and into a forward space between the forward mount wall 226 and the first intermediate mount wall 244. The second attachment flange 256 extends radially outward from the shroud wall 252 into an aft space between the second intermediate mount wall 246 and the aft mount wall 238.

In this embodiment, each retainer 216 includes a single pin 262 as shown in FIG. 5. The single pin 262 extends from the forward mount wall 226, into the aft mount wall 238, passing through the first and second attachment flanges 254, 256 and through the intermediate mount 236. Each clip shim 217 includes a shim wall 219, a clip wall 221, and a top wall 223, as shown in FIG. 5. The shim wall 19 extends radially inward from the top wall 223 around the single pin 262 and into the space between the second attachment flange 256 and the second intermediate wall 246. The shim wall 219 is defined to form a first pin receiving cutout 225 and urges engagement between the chordal seal 250 and the engagement lip 228 to block the flow of gases. The clip wall 221 is spaced axially from the shim wall 219 and extends radially inward from the top wall 223 around the single pin 262 and into the space between the second attachment flange 256 and the aft flange 248. The clip wall 221 is defined to form a second pin receiving cutout 227. The top wall 223 extends axially from the shim wall 219 to the clip wall 221.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine shroud assembly for use with a gas turbine engine, the turbine shroud assembly comprising a carrier assembly made of metallic materials and arranged circumferentially at least partway around an axis, the carrier assembly including an outer wall, a forward mount wall that extends radially inward from the outer wall, an intermediate mount that includes a first intermediate mount wall that extends radially inward from the outer wall and a second intermediate mount wall that extends radially inward from the outer wall, and an aft mount wall axially spaced apart from the intermediate mount and that extends radially inward from the outer wall, wherein the aft mount wall includes an aft flange and a chordal seal that extends axially away from the aft flange, a blade track segment made of ceramic matrix composite materials, the blade track segment supported by the carrier assembly to locate the blade track segment radially outward of the axis and define a portion of a gas path of the turbine shroud assembly, and the blade track segment including a shroud wall that extends circumferentially partway around the axis, a first attachment flange that extends radially outward from the shroud wall into a forward space between the forward mount wall and the first intermediate mount wall, and a second attachment flange that extends radially outward from the shroud wall into an aft space between the second intermediate mount wall and the aft mount wall, a retainer that includes a forward pin that extends through the first attachment flange and into the first intermediate mount wall and an aft pin that extends into the second intermediate mount wall, through the second attachment flange, and into the aft mount wall so as to couple the blade track segment to the carrier assembly, and a clip shim arranged around the second attachment flange and configured to engage the second attachment flange and the second intermediate mount wall and urge the second attachment flange axially aft relative to the axis and into engagement with the chordal seal.

2. The turbine shroud assembly of claim 1, wherein the clip shim includes a top wall that extends axially, a shim wall that extends radially from the top wall and is located axially between and engaged with the second intermediate mount wall and the second attachment flange, and a clip wall that is spaced apart from the shim wall and extends radially from the top wall along the second attachment flange.

3. The turbine shroud assembly of claim 2, wherein the shim wall, the clip wall, and the top wall cooperate to provide a spring force that clamps the clip shim onto the second attachment flange.

4. The turbine shroud assembly of claim 2, wherein the shim wall forms a first pin receiving cutout that extends radially outward and is sized to receive at least a first portion of the retainer.

5. The turbine shroud assembly of claim 4, wherein the clip wall forms a second pin receiving cutout that extends radially outward and is sized to receive at least a second portion of the retainer.

6. The turbine shroud assembly of claim 1, wherein the fore carrier segment further includes an engagement lip that extends axially aft from the forward mount wall and engages the first attachment flange of the blade track segment.

7. The turbine shroud assembly of claim 1, wherein the forward mount wall and the aft mount wall are spaced apart axially by a distance such that the engagement lip and the chordal seal apply an axial compressive force to the first attachment flange and the second attachment flange.

8. The turbine shroud assembly of claim 1, wherein the forward pin has an aft most end that extends into the first intermediate mount wall and terminates axially forward of the second intermediate mount wall and the aft pin has a fore most end that extends into the second intermediate mount wall and terminates axially aft of the first intermediate mount wall.

9. A turbine shroud assembly for use with a gas turbine engine, the turbine shroud assembly comprising a carrier assembly arranged circumferentially at least partway around an axis, the carrier assembly including an outer wall and a forward mount wall that extends radially inward from the outer wall, an intermediate mount that extends radially inward from the outer wall, and an aft mount wall axially spaced apart from the intermediate mount and that extends radially inward from the outer wall, a blade track segment supported by the carrier assembly, the blade track segment including a shroud wall that extends circumferentially partway around the axis, a first attachment flange that extends radially outward from the shroud wall into a forward space between the forward mount wall and the intermediate mount, and a second attachment flange that extends radially outward from the shroud wall into an aft space between the intermediate mount and the aft mount wall, a retainer that extends into the forward mount wall, the first attachment flange, the intermediate mount, the second attachment flange, and the aft mount wall so as to couple the blade track segment to the carrier assembly, and a clip shim located between the intermediate mount and the second attachment flange and configured to urge the second attachment flange axially aft toward the aft mount wall, wherein the clip shim includes a top wall that extends axially, a shim wall that extends radially from the top wall and is located axially between and engaged with the second intermediate mount wall and the second attachment flange, and a clip wall that is spaced apart from the shim wall and extends radially from the top wall along the second attachment flange.

10. The turbine shroud assembly of claim 9, wherein the aft mount wall includes an aft flange and a chordal seal that extends axially away from the aft flange and the clip shim urges the second attachment flange into engagement with the chordal seal.

11. The turbine shroud assembly of claim 9, wherein the shim wall, the clip wall, and the top wall cooperate to provide a spring force that clamps the clip shim onto the second attachment flange.

12. The turbine shroud assembly of claim 9, wherein the shim wall forms a first pin receiving cutout that extends radially outward and is sized to receive at least a first portion of the retainer.

13. The turbine shroud assembly of claim 12, wherein the clip wall forms a second pin receiving cutout that extends radially outward and is sized to receive at least a second portion of the retainer.

14. The turbine shroud assembly of claim 9, wherein the retainer includes a first pin that extends into the forward mount wall, through the first attachment flange, and into the intermediate mount and an aft pin that extends into the intermediate mount, through the second attachment flange, and into the aft mount.

15. The turbine shroud assembly of claim 9, wherein the intermediate mount includes a first intermediate mount wall and a second intermediate mount wall spaced apart axially from the first intermediate mount wall to form a gap therebetween.

16. The turbine shroud assembly of claim 9, wherein the retainer includes a pin that extends continuously into the forward mount wall, the first attachment flange, the intermediate mount, the second attachment flange, and the aft mount wall.

17. A method of forming a turbine shroud assembly, comprising providing a carrier assembly having an outer wall, a first mount wall that extends radially inward from the outer wall, an intermediate mount that extends radially inward from the outer wall, and a second mount wall axially spaced apart from the intermediate mount and that extends radially inward from the outer wall, providing a blade track segment made of ceramic matrix composite materials, the blade track segment including a shroud wall that extends circumferentially partway around the axis, a first attachment flange that extends radially outward from the shroud wall, and a second attachment flange that extends radially outward from the shroud wall, arranging a clip shim between the intermediate mount and the second attachment flange to cause the clip shim to urge the second attachment flange toward the second mount wall, and inserting a retainer into the first mount wall, the first attachment flange, the intermediate mount, the second attachment flange, and the second mount wall, wherein the second mount wall is formed to include a flange and a chordal seal that extends axially away from the flange and engages the second attachment flange, wherein the clip shim includes a top wall that extends axially, a shim wall that extends radially from the top wall and is located axially between and engaged with the intermediate mount and the second attachment flange, and a clip wall that is spaced apart from the shim wall and extends radially from the top wall along the second attachment flange.

* * * * *